US005237933A

United States Patent [19]

Bucksbee

[11] Patent Number: 5,237,933

[45] Date of Patent: Aug. 24, 1993

[54] SERVICE-LIFE, LOW-PROFILE, RETROFITTABLE, ELASTOMERIC MOUNTING FOR THREE-PIECE, RAILROAD-CAR TRUCKS

[75] Inventor: James H. Bucksbee, Erie, Pa.

[73] Assignee: Lord Corporation, Erie, Pa.

[21] Appl. No.: 735,593

[22] Filed: Jul. 25, 1991

[51] Int. Cl.[5] ..... B61F 5/26

[52] U.S. Cl. ..... 105/224.1

[58] Field of Search ..... 105/218.1, 222, 223, 105/224.1, 225; 267/141.1, 141, 153

[56] References Cited

U.S. PATENT DOCUMENTS

| | | | |
|---|---|---|---|
| 2,299,560 | 10/1942 | Travilla | 105/222 |
| 3,134,585 | 5/1965 | Trask | 267/141.1 |
| 3,211,112 | 10/1965 | Baker | 105/224.1 |
| 3,274,955 | 9/1966 | Thomas | 105/224.1 |
| 3,276,395 | 10/1966 | Heintzel | 105/224.1 |
| 3,381,629 | 5/1968 | Jones | 105/218 |
| 3,621,792 | 11/1971 | Lich | 105/224.1 |
| 3,638,582 | 2/1972 | Beebe | 105/218 R |
| 3,699,897 | 10/1972 | Sherrick | 105/218 R |
| 3,785,298 | 1/1974 | Reynolds | 105/218 R |
| 3,897,736 | 8/1975 | Tack | 105/223 |
| 3,965,825 | 6/1976 | Sherrick | 105/224.1 |
| 4,026,217 | 5/1977 | Cross et al. | 105/224.1 |
| 4,363,278 | 12/1982 | Mulcahy | 105/218 |
| 4,413,569 | 11/1983 | Mulcahy | 105/224.1 |
| 4,416,203 | 11/1983 | Sherrick | 105/224.1 |
| 4,483,253 | 11/1984 | List | 105/167 |
| 4,552,074 | 11/1985 | Mulcahy et al. | 105/224.1 |
| 4,655,143 | 4/1987 | List | 105/168 |
| 4,674,412 | 6/1987 | Mulcahy et al. | 105/224.1 |
| 4,785,740 | 11/1988 | Grandy | 105/225 |
| 4,938,152 | 7/1990 | List | 105/208 |
| 5,009,521 | 4/1991 | Wiebe | 384/191.1 |

*Primary Examiner*—Douglas C. Butler
*Assistant Examiner*—Kevin D. Rutherford
*Attorney, Agent, or Firm*—Randall S. Wayland; Richard K. Thomson

[57] ABSTRACT

An improved service-life, low-profile, elastomeric mounting for placement between the side-frame-pedestal-jaw roof and the axle-box or axle-bearing adapter crown on a three-piece, railroad-car truck. The mounting minimizes the damaging compression induced edge strains resulting from the cocking motions imposed on the elastomeric mounting during railroad car braking and rocking. The addition of shims, specialized elastomer contouring, graded thicknesses of the elastomeric layers in combination with high shape factor of the elastomeric layers allows the compression induced edge strains to be significantly reduced and results in extended service-life of the elastomeric mounting.

23 Claims, 5 Drawing Sheets

"PRIOR ART"

SERVICE-LIFE, LOW-PROFILE, RETROFITTABLE, ELASTOMERIC MOUNTING FOR THREE-PIECE, RAILROAD-CAR TRUCKS

FIELD OF THE INVENTION

The subject invention relates to the area of elastomeric mountings, and more specifically to elastomeric mountings for the steering system of a three-piece, railroad-car truck which includes two truck side frames with side-frame-pedestal jaws, and a truck bolster interconnecting the two side frames, which comprise the three pieces. Each truck also includes two axles, axle-bearings, axle-box or axle-bearing adapters, and two wheel sets.

BACKGROUND OF THE INVENTION

Elastomeric mountings have long been used for the primary suspension systems of railroad car trucks. Prior to the advent of these flexible mounting systems, wear surfaces were utilized as described in U.S. Pat. No. 4,785,740. The advantages of using elastomeric mountings over wear surfaces is described in U.S. Pat. Nos. 3,785,298, 4,483,253, 4,655,143, and 4,938,152 relating to self-steering railroad-car trucks. Following the invention of the basic self-steering truck, several developments led to improvements in the mountings themselves, as witnessed in several U.S. patents to be described later. These elastomeric mountings are positioned between the axle-box or axle-bearing adapter crown and side-frame-pedestal-jaw roof on a railroad-car truck. The elastomeric mountings provide controlled flexibility in all directions and have many advantages over the previously used metal to metal sliding surfaces or similar wear surfaces. These advantages include, reduced lateral and vertical shocks to the roller bearings, increased system damping, elimination of wear between the axle-box or axle-bearing adapter crown surface and the side-frame-pedestal-jaw roof, reduction in railroad-car wheel wear, reduced rail wear, improved life of truck components and bearings, and finally, elastomeric mounts provide for a squaring relationship between the railroad track and the railroad-car trucks.

Elastomeric mountings for railroad-car trucks can be made extremely stiff in compression for carrying large compressive loads resulting from railroad car and cargo weight, and yet remain flexible in shear for accommodating motions between the axle sets and the side-frames. The addition of controlled spring rates provides self-steering and controls vehicle dynamics. Patents have issued for many variations and improvements to these basic elastomeric mountings, and they generally fall into two categories. Patents which describe retrofittable mountings are described in U.S. Pat. Nos. 3,381,629; 3,638,582; 3,699,897; 4,363,278; and 4,674,412; and those which are generally directed toward highly sophisticated elastomeric mountings, where the elastomeric mounting and the railroad-car-pedestal jaw, axle-box or axle-bearing (hereinafter, the term axle-bearing will be used as the short hand for this alternative) adapter and attachment features evolved together are described in U.S. Pat. Nos. 4,416,203, 3,621,792, 4,026,217. The more difficult dilemma presents itself with the former group, where the elastomeric mounting must adapt to, improve, or retrofit the currently adequate three-piece, railroad-car truck. One embodiment of the present invention mounting has to be able to be used on new three-piece, railroad-car trucks, retrofit trucks which are currently in the field and have only wear surfaces, and replace the "prior art" limited service-life elastomeric mounting shown in FIG. 1.

The single-layer "prior art" elastomeric mounting shown therein is experiencing limited service-life due to elastomer degradation and disbonding at the free edge of the mounting. Although the "prior art" design lasts sufficiently long to offer an economic advantage for the railroads to use it, customers are demanding extended service life and have long sought such an advantage to further reduce operating costs.

Originally, the cause of the limited service life of the "prior art" configuration was not well understood. However, after much study and analysis by the inventor, the cause of the premature failures of the "prior art" mounting was determined. The previously unrecognized or misunderstood problem was a result of a low ratio of cocking stiffness to shear stiffness of the elastomeric mounting. The "prior art" mounting's cocking stiffness was so low as to allow the axle-bearing adapter crown to cock relative to the side-frame-pedestal-jaw roof during braking and railroad-car rocking. When applied braking forces tend to move the axles apart in the fore and aft direction, this deflection is taken up or accommodated in the "prior art" mounting. The rocking motion is due to hunting and other vehicle dynamics and causes lateral motions to be applied to the mounting. These lateral and fore and aft motions initially were thought to be accommodated by the "prior art" mounting as pure shear by those of skill in the art. However, because of the low cocking to shear stiffness ratio of the "prior art" design, the braking and rocking induces a combination of cocking and shear into the prior art mountings.

In fact, because of this low ratio, a high percentage of the motion is accommodated as cocking, when originally it was thought to be accommodated in shear. As a result of these high cocking motions, compression induced edge strains occur at the edges of the "prior art" mounting. These edge strains are directly responsible for the limited service-life of the "prior art" elastomeric mountings. Further, the described cocking motions tend to be much more detrimental to the service life of the mounting than pure shear motions would be. Therefore, it was determined that to increase the useful service-life, the cocking stiffness to shear stiffness ratio must be increased and the compression induced edge strains must be reduced by some means.

SUMMARY OF THE INVENTION

The problem of limited service-life of the "prior art" mounting shown in FIG. 1 is solved by the present invention by substantially decreasing the compression induced edge strains, without substantially changing the shear spring rate, the attachment features, or ride height of the railroad-car truck. This was accomplished without diminishing any of the benefits of the elastomeric mountings of the "prior art". These improvements also allow the same device to be utilized for retrofitting cars which are in service, as well as being installed on new cars, without any major design changes to the side frame or axle-bearing adapters.

The invention solves the limited service life problem, yet meets the rigorous requirements of the railroad industry. One of these requirements relates to the ride height of the railroad-car truck. The ride height must not increase significantly over a three-piece, railroad-car truck which is not elastomerically mounted, i.e., one utilizing wear surfaces. This requirement is imposed for purposes of maintaining railroad-car coupling height. The differential coupling height between the cars with and without elastomeric mounts, is not to exceed a specified dimension for insuring proper and safe coupling.

Another requirement is that the shear stiffness must not be substantially changed relative to the "prior art" mount, so that a) the alignment-restoring capability for squaring the railroad-car truck to the track is maintained, and b) the vehicle dynamics are not changed dramatically. Further, the attachment features must allow the elastomeric mounting to be retrofitted to a three-piece, railroad-car truck or used on a new truck without any major modifications to the railroad-car-truck-pedestal-jaw roof or axle-bearing adapter crown. In some cases, minor modifications may be necessary for the improved invention such as, a bead of weld added to, or a recess or hole milled in, the side-frame-pedestal-jaw roof or axle-bearing adapter. This will restrain the movement of the mounting top and bottom plates relative to the side-frame-pedestal jaw and axle-bearing adapters. However, these minor modifications can be performed in the field easily. An additional requirement is that the improved service-life and retrofitting features be met with minimal increase in cost, such that there still is a significant economic value to the customer. The dramatic improvement in service-life is a result of changes to a number of key elements of the improved invention.

The first element is the significantly higher shape factor (SF) of the elastomeric mounting. If the shape factor of the layer is increased, the compression stiffness of the layer also increases. This, in turn, indirectly increases the cocking stiffness of the part. An intermediate shim was added to help accomplish this change in shape factor. Thus, now under the applied braking loads and railroad-car rocking, the elastomeric mounting translates more in shear and experiences less cocking.

Service-life was further increased through the addition of specialized contouring to the edge of the elastomeric mounting layers. These contours help to minimize the compression induced edge strains or pinching. Further improvements are provided by grading the thickness of the layers of the present invention. By increasing the layer thickness of each elastomeric layer towards the edge of the elastomeric layer, the compression-induced edge strains can be further decreased. All of these improvements were made with retrofitting and the aforementioned requirements in mind.

The subject invention meets all these imposed requirements and also dramatically increases the service life of the "prior art" elastomeric mounting. Current "prior art" designs as shown in FIG. 1, have an estimated service life of 200,000 miles. The improved retrofittable mounting has an estimated service life of 1,000,000 miles. The improvement in service life was demontstrated in the laboratory by testing under equivalent conditions where the subject invention endured 600,000 cycles with little damage and the testing of the prior art mounting had to be stopped at 150,000 cycles. Since replacement is an expensive procedure for the railroad industry, as it costs mechanics' time, the cost of the replacement part, and downtime cost of the railroad car, it is very desirable for the mounting to have an improved service-life. Various other features, advantages and characteristics of the present invention will become apparent after reading the following detailed description.

BRIEF DESCRIPTION OF THE DRAWINGS

The accompanying drawings which are incorporated in, and form a part of this specification, illustrate several key embodiments of the present invention. The drawings and description together, serve to fully explain the invention. In the drawings.

DESCRIPTION OF THE PREFERRED EMBODIMENTS

Figure 1:
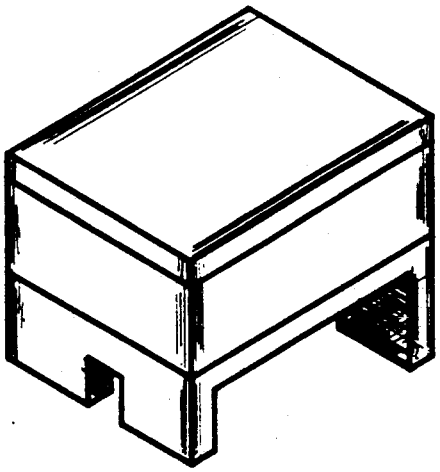
FIG. 1 is an isometric view of the "prior art" elastomeric mounting showing a top plate, a bottom plate and a single body of elastomer.
Figure 2:
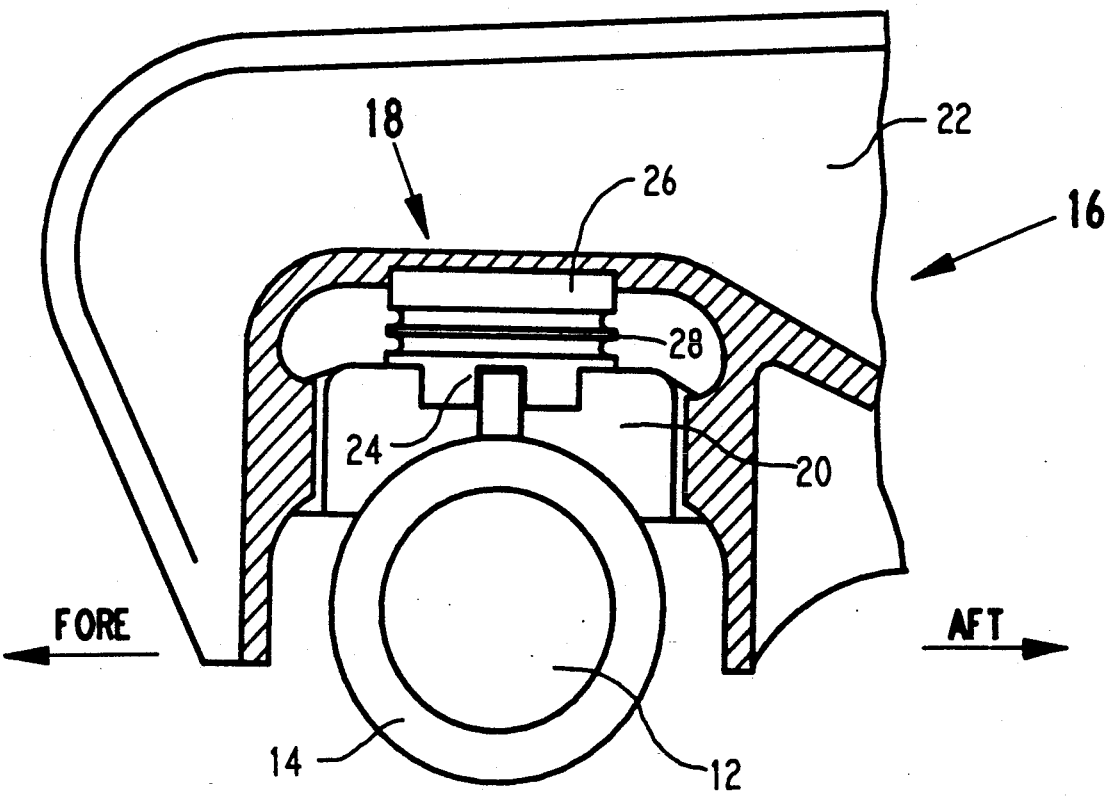
FIG. 2 is a side view of the installation of the elastomeric mounting of the present invention shown installed between the side-frame-pedestal-jaw roof and the axle-bearing adapter crown on a three-piece, railroad-car truck.
Figure 3:
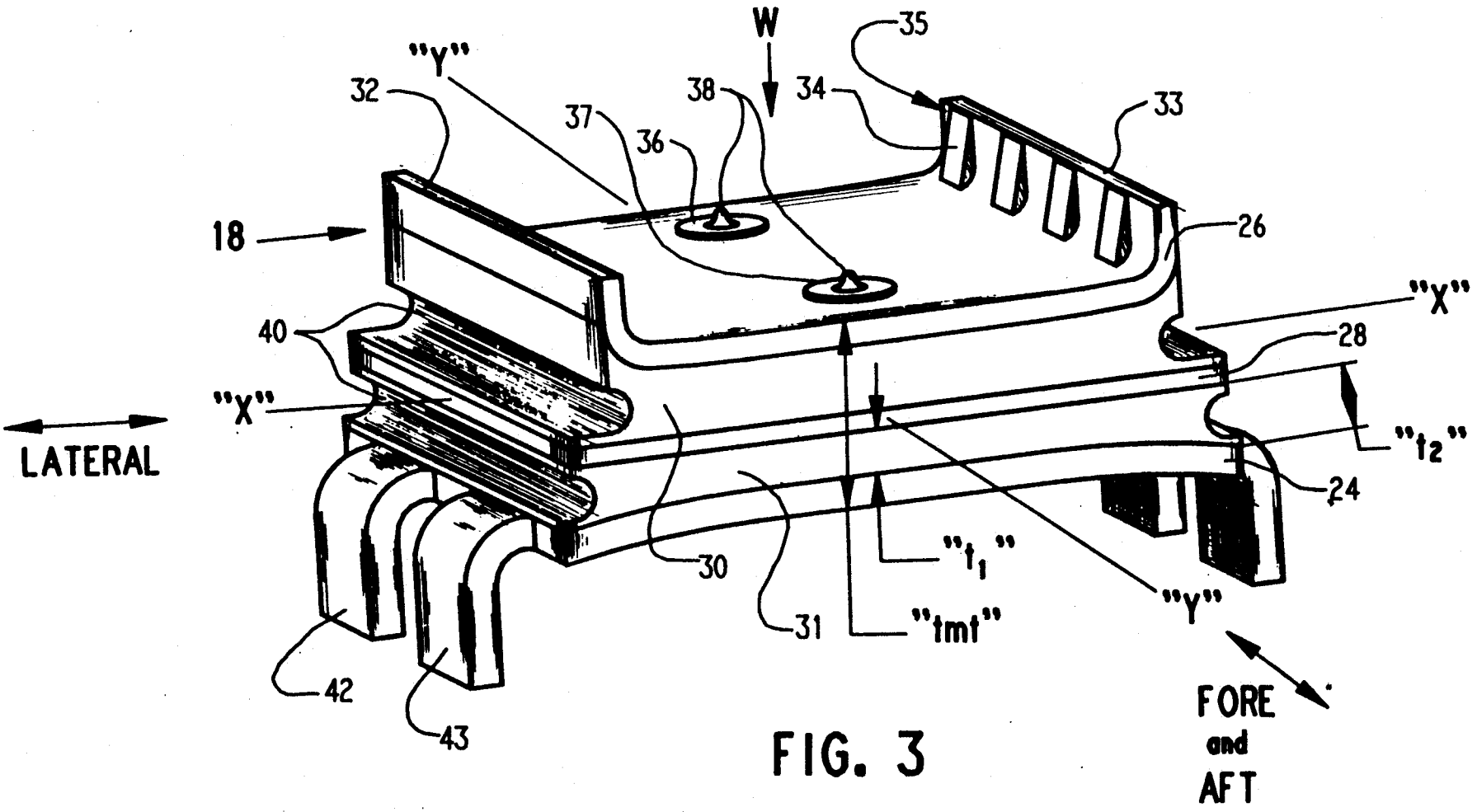
FIG. 3 is an isometric view of a first embodiment of an improved-service-life, low-profile, retrofittable, elastomeric mounting for a three-piece, railroad-car truck with forked, downwardly depending flanges.

Each embodiment of the low-profile, retrofitable, improved-service-life, elastomeric mounting 18 is installed on the railroad-car truck 16 as shown in FIG. 2. The assembly comprises the following key components: an axle 12 surrounded by an axle bearing 14; an axle-bearing adapter 20 which rides on top of the axle 14; and a mounting 18 which attaches between the axle-bearing adapter 20 and the side-frame-pedestal jaw 22. Each embodiment of the mounting 18, further comprises: a bottom-plate means 24, a top-plate means 26 and a shim means 28. The increase in service-life of the present invention is a direct result of improvements in these components and their assembly, which serve to increase the cocking stiffness to shear stiffness ratio and reduce the compression induced edge strains. The first improvement is the result of significantly higher shape factor (SF) of the improved elastomeric mounting 18 as shown in FIG. 3. The shape factor is the ratio of the load area (La) to bulge area (Ba) and is given by Equation 1.

$$SF = La/Ba \qquad \text{Equation 1.}$$

The load area (La) is the area of each elastomeric layer 30, 31 in a plane perpendicular to the direction of statically applied weight (W). The Bulge area (Ba) is the area at which the elastomeric layer 30, 31 is allowed to bulge. In this case, it is in a plane parallel to the direction of statically applied weight (W). Because of the very high bulk modulus (100,000–250,000 psi) of elastomers and relatively low shear modulus (30–300 psi), any applied load will cause the elastomer to shear within the layer 30, 31 rather than to compress. Thus, this compression loading builds or induces strains to occur at the free edge of the elastomeric layers 30, 31. These are known as compression-induced edge strains and are the strains associated with the limited service-life of the "prior art". If the shape factor of the layer 30, 31 is increased, the compression stiffness of the layer increases correspondingly. This, in turn, indirectly increases the cocking stiffness of the mounting 18 about the "X"—"X" axis or "Y"—"Y" axis. In order to keep the shear stiffness relatively constant, it is important not to substantially change the total elastomer thickness. Decreasing this thickness will increase the shear strains and, in turn, will lead to lower service-life as well as alter vehicle dynamics. Substantially increasing the total mounting thickness (tmt) of the elastomeric mounting 18 would increase the ride height required for safe railroad-car coupling. The current acceptable tmt is 1.25 inch, for providing safe coupling. Therefore, in order to increase the cocking stiffness to shear stiffness ratio and not change the shear stiffness substantially, an intermediate shim 28 was added. The addition of this shim results in the required shape factor needed for cocking restraint. The resultant spaces between the shim 28 and the respective bottom plate 24 and top plate 26 are filled with a suitable elastomer material such as natural rubber, thermoplastic elastomer, synthetic elastomer or blends of the aforementioned. Any suitable process can be used for transferring the elastomer into the mounting. Typical processes may include transfer molding, compression molding, cold bonding, or injection molding. In fact, the elastomer would not necessarily need to be bonded at all, and could be mechanically fastened via any suitable means, such as tabs or molded retention buttons extending through the receiving holes in the respective bottom plate 24, top plate 26 and shim 28. The addition of the shim increases the shape factor from SF=4 of the "prior art" to SF=8, or more of the present invention. This is an increase in shape factor of at least a factor of two. This change increased the cocking stiffness to shear stiffness ratio by a much larger factor of nine or more. Thus, now under the applied braking loads and railroad-car rocking, the elastomeric mounting 18 translates more in shear and experiences much less cocking motion. This results in substantially lower compression-induced edge strains. The addition of a shim, while substantially maintaining the total elastomer thickness so as not to change the shear spring rate or ride height, contributed to the increased service-life.

The first preferred embodiment (FIG. 3) further includes upwardly depending flanges 32, 33 for lateral positioning and restraint relative to the side-frame-pedestal jaw 22 (FIG. 2). On the surface of the elastomeric mounting 18, which contacts the side-frame-pedestal jaw 22, there can be elastomeric protrusions 34 for centering the upwardly depending flanges 32, 33 relative to the side-frame-pedestal jaw 22 and for taking up the play resulting from manufacturing tolerances.

The top plate 26 may optionally have one or more holes 36, 37 therethrough for equalizing pressures during bonding or molding, and to aid in elastomer transfer process during bonding. These holes 36, 37 may not be required at all, depending on requirements. Adding these top-plate holes 36, 37 will keep the bonding sprues 38, which act as stress risers from being located at the fore and aft edge of the elastomeric layer 30, 31, where they adversely impact service life. The holes also serve the purpose of allowing the elastomer to get to both sides of the top plate 26 for formation of a corrosion-preventing protective skin of elastomer 35 and allow for forming the elastomeric protrusions 34. In addition, they aid in locating the top plate 26 and in transferring of elastomer into the layers 30, 31. A portion of the mounting may optionally be coated with some other corrosive protection such as adhesive, paint or rust prohibitive. The bottom plate 24 may also have at least one hole therethrough for the same purposes as stated above and the shim 28 can have at least one hole therethrough for equalizing bonding pressures, also.

The shim 28, in all the embodiements, can be made of any material having suitable strength such as steel, aluminum, engineered plastic, composite, or the like. Shims 28 may be heat treated to increase strength and add an extra safety margin, especially when the holes for bonding have been included. The bottom plate 24 and top plate 26 can be of any suitable material for reacting the applied loading, such as steel, aluminum, engineered plastic, composite, or the like. Further, any suitable forming technique for the bottom plate 24 and top plate 26, such as steel stamping, forging, casting or molding, is acceptable.

The bottom-plate means 24 of the first embodiment is attached to the axle-bearing adapter 20 by downwardly depending flanges 42, 43. These flanges are arranged such that they restrain movement of the bottom plate 24 relative to the axle-bearing adapter plate 20 in the lateral, as well as the fore and aft, directions. This is accomplished by utilizing flanges 42, 43 which form a forked, or prong-like, arrangement. Flanges 42, 43 engage with the axle-bearing adapter 20. The length and width of the flanges 42, 43 are selected to limit the relative movement between the bottom plate 24 and the axle-bearing adapter 20 (FIG. 2). The attachment and restraining means which are used for the bottom plate 24 can obviously be applied to the top plate 26, and visa versa.

The addition of specialized elastomer contour means 40 to the edge of the elastomeric layers 30, 31 led to further improved service-life. These contours 40 help to further reduce the compression induced edge strains or pinching, even over the reductions achieved by incorporating the higher shape factor. The contours 40 can be placed along any edge of the elastomeric layers 31, 32 where damage is occurring. Many different contours 40 were tried; combinations of finite element analysis and service-life testing indicates that adding a contour 40 has a significant benefit towards improving service life. In particular, circular and elliptical contours 40 were analyzed and circular contours were incorporated, having been shown to be particular benefit.

Another key feature is the grading of the thickness of the elastomeric layers 30, 31 of the present invention to further improve the service life. By increasing the layer thickness of each elastomeric layer 30, 31 towards the edge of the mounting 18, the compression-induced edge strains can be further decreased. A clear example of this is shown in FIG. 3 where "$t_1$" is at the center of the layers 30, 31 and "$t_2$" is at the edge of the layers 30, 31. An optimum range of the ratio of $t_2/t_1$ for these applications is $t_2/t_1=1.05-1.30$. Although grading has been shown in only one direction, elastomeric layer 30, 31 thickness grading can be accomplished in either the fore and aft direction, the lateral direction, or both, for reducing edge strains resulting from railroad-car rocking and braking. Further optimization can be obtained through grading the relative thicknesses of each of first and second layers 30, 31 as a function of the load area of each layer 31, 32. For example, space or manufacturing limitations may require the load area of one layer 31, 32 be less than the other, such that the mounting has a tapered profile. To optimize the service-life between the layers 31, 32, such that both degrade at the same rate, the average layer thickness of each layer would be graded separately. The layers 30, 31 with more load area would be thicker, such that the strains are equalized with the thinner layer 30, 31 having less load area.

Figure 4:
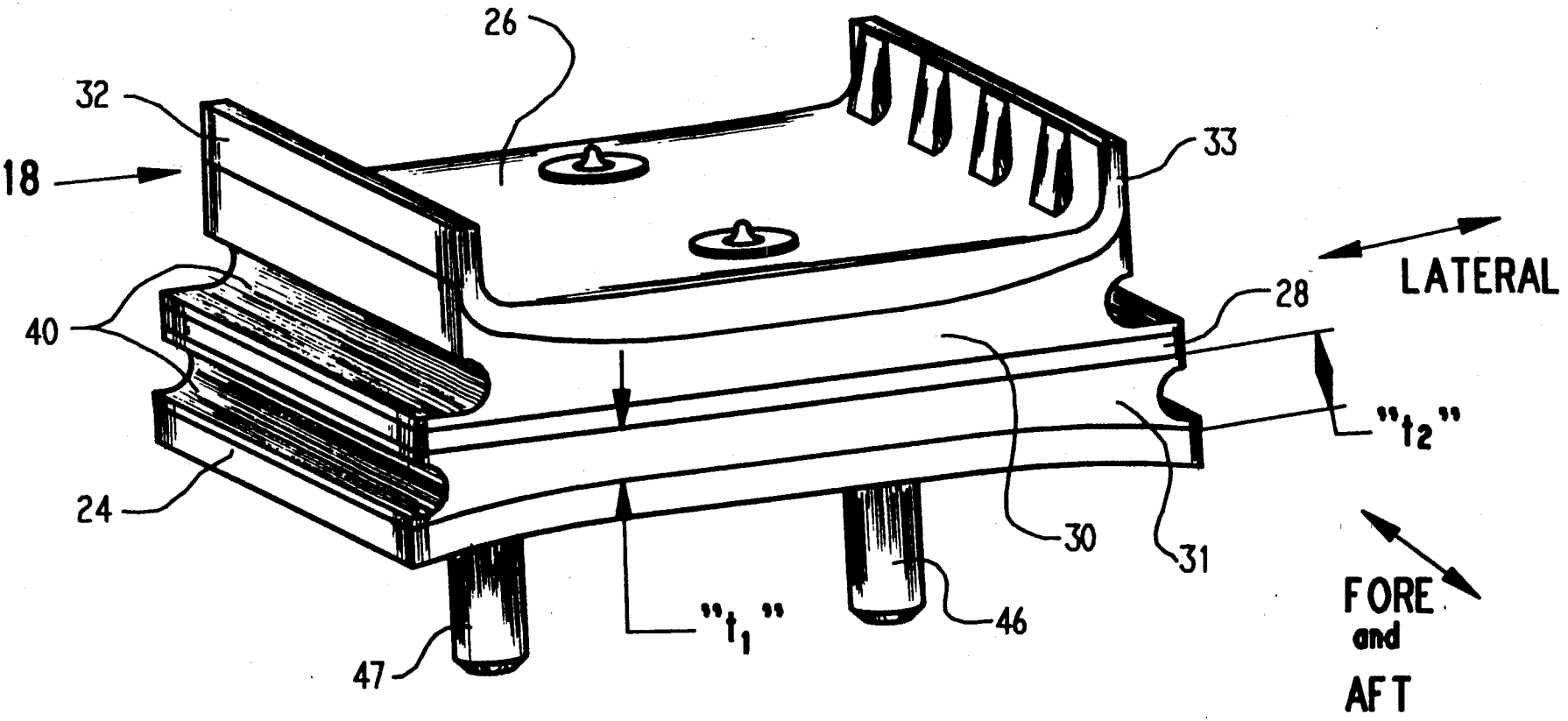
FIG. 4 is an isometric view of a second embodiment of an improved-service-life, low-profile, retrofittable, elastomeric mounting for a three-piece, railroad-car truck with chamfered pins depending from the bottom plate.

The second embodiment, which is shown in FIG. 4, is comprised of a top-plate means 26 that is essentially the same as the top plate 26 of the first embodiment. Further, the second embodiment comprises upwardly depending flanges 32, 33, shim means 28, contour means 40, thickness grading from "$t_1$" to "$t_2$" within each elastomeric layer 30, 31, and bottom-plate means 24. The bottom plate 24 has restraining means comprised of a plurality of pins 46, 47. This bottom plate 24 component contains the major differences relative to the first embodiment.

The pins can be of any material suitable for reacting the applied shear loading, such as steel, aluminum, engineered plastic, or the like. Preferably, these pins 46, 47 should be chamfered on their peripheral edges for ease of installation. The pins 46, 47 can be either welded to, pressed into, riveted onto, or bonded onto the bottom plate 24 to enable the pins 46, 47 to carry shear loads and to aid in centering and locating the mounting 18. The pins allow for the retrofittable feature, much the same way as the downwardly depending flanges 42 did for the first embodiment. In the field, a plurality of holes would be bored into the axle-bearing adapter 20 for accepting the pins 46, 47. Controlling the clearance between the pins 46, 47 and these holes will restrain the lateral as well as fore and aft movement between the bottom plate 24 and axle-bearing adapter 20. Variations in the restraining features and combinations of restraint methods can be used as well, such as a combinations of a pin and a flange. The attachment and restraining means which are used for the bottom plate 24 can obviously be applied to the top plate 26, and visa versa.

Figure 5:
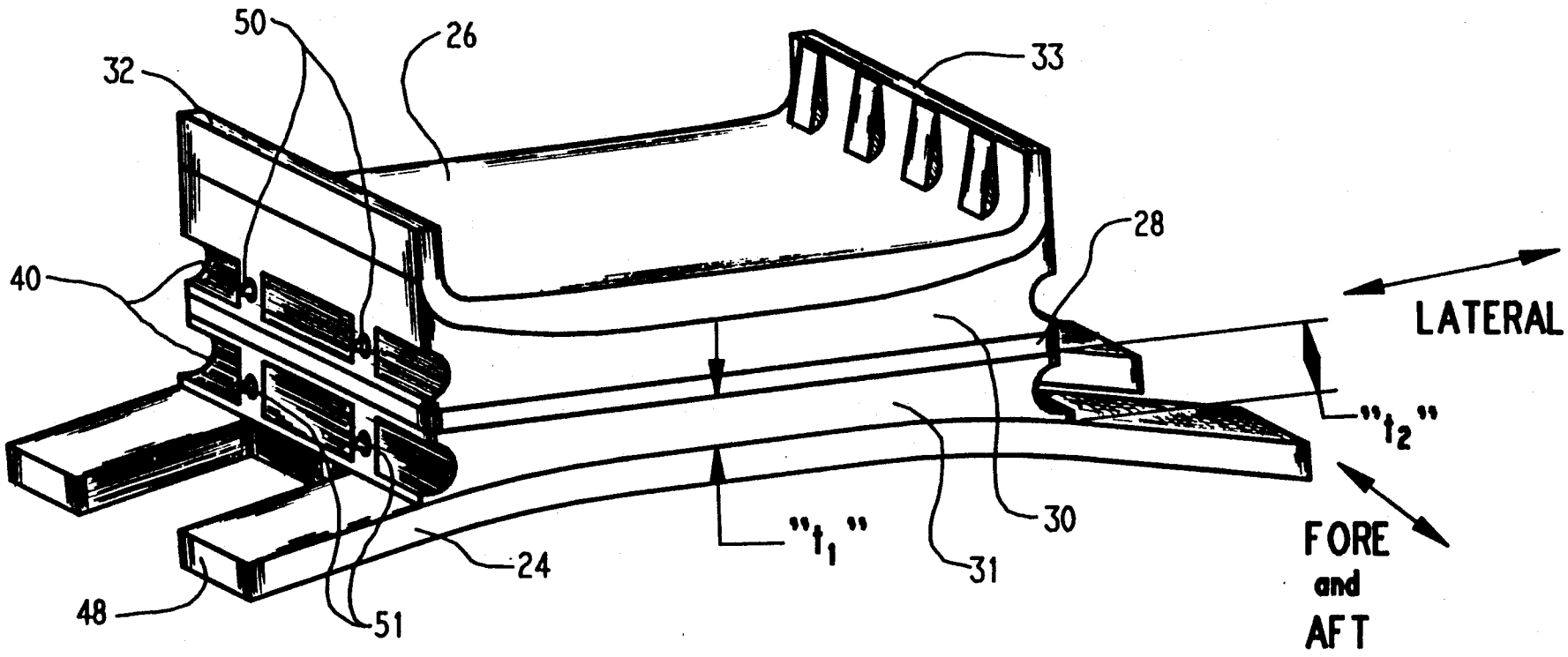
FIG. 5 is an isometric view of a third embodiment of an improved-service-life, low-profile, retrofittable, elastomeric mounting for a three-piece, railroad-car truck with an "H" shaped bottom plate.

The third embodiment shown in FIG. 5 is comprised of a top-plate means 26 with upwardly depending flanges 32, 33, shim means 28, contour means 40, and thickness grading from "$t_1$" to "$t_2$" within each elastomeric layer 30, 31 and bottom-plate means 24. The differences between this third embodiment and the first embodiment are the bottom plate 24, the side sprues 50, 51 and the deletion of the top and bottom plate holes. For some applications, top sprues 38, 39 and holes 36, 37 for location or bonding purposes are not required. The bottom plate 24 has restraining means which are comprised of a plurality of tabs 48 extending generally in the lateral direction. These tabs 48 restrain the bottom plate 24 from moving relative to the axle-bearing adapter 20 in the lateral and fore and aft directions. The bottom plate 24 forms essentially an H pattern extending generally in the lateral direction for providing this restraint. The restraint is a result of the tabs 48 engaging with the axle-bearing adapter 20. Appropriate clearances are selected to allow the lateral and fore and aft restraint. Variations in the restraining features and combinations of restraint methods can be used as well, such as a combinations of a pin and a flange. The attachment and restraining means which are used for the bottom plate 24 can obviously be applied to the top plate 26, and visa versa, as with the previous embodiments.

Figure 6:
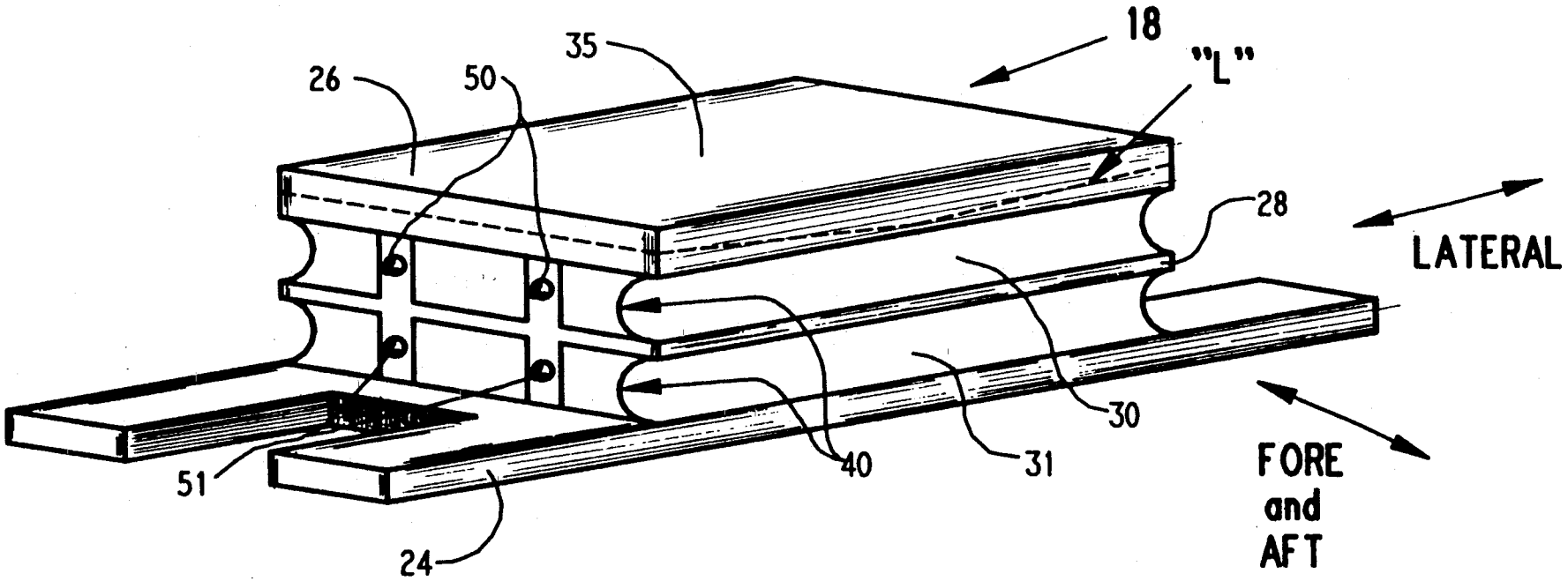
FIG. 6 is an isometric view of a fourth embodiment of an improved-service-life, low-profile, retrofittable, elastomeric mounting for a three-piece, railroad-car truck with a flat "H" shaped bottom plate and flat top plate.

The fourth embodiment shown in FIG. 6 is comprised of a top-plate means 26 which is flat for contacting the pedestal jaw and rectangular or approximately square in shape. The flat top plate will be restrained from movement relative to the pedestal jaw 22 by friction. In some cases a recess will be milled into the roof of the pedestal jaw 22. This embodiment includes a shim means 28, and contour means 40 which are on the fore and aft sides of the mounting 18. This embodiment is not shown graded for thickness within each elastomeric layer 30, 31. However, this could be easily accomplished by removing the material from the top plate up to the shape indicated by dotted line "L". This embodiment has a bottom-plate means 24 similar to the third embodiment, except this has a flat "H" pattern.

The differences between this fourth embodiment and the first embodiment are found in the bottom plate 24, side sprues 50, 51 and the deletion of the top and bottom plate holes. As previously mentioned, top sprues 38, 39 and holes 36, 37 for location or bonding purposes are not required or desired for certain applications. In this case, the sprues 50, 51 may be located at some other point where they will have the least impact on service-life. Since the damage is mostly due to breaking in the fore and aft direction, an acceptable alternate position is in the lateral faces of the mounting.

The bottom plate 24 has restraining means which are comprised of a plurality of tabs 48 extending in the lateral direction. These tabs 48 restrain the bottom plate 24 from moving relative to the axle-bearing adapter 20 in the lateral and fore and aft directions. The bottom plate 24 forms an H pattern extending in the lateral direction for providing this restraint. The restraint is a result of the tabs 48 engaging with the axle-bearing adapter 20. Appropriate clearances are selected to allow the lateral and fore and aft restraint. Variations in the restraining features and combinations of restraint methods can be used as well, such as a combinations of a pin and a flange. The attachment and restraining means which are used for the bottom plate 24 can obviously be applied to the top plate 26, and visa versa, as with the previous embodiments.

The several embodiments described above all provide for the an increase in service-life over the "prior art". Further, the improved mounting 18 offers retrofitting features which allow the mounting 18 to be used on three-piece, railroad-car trucks 16 that are new, as well as those currently in the field. This much demanded service-life improvement is achieved by novel combinations of higher shape factors of the elastomeric layers 30, 31, adding a shim 28 to the mounting 18, adding contours 40 to the elastomeric layers 30, 31 in accordance with the specific results of analysis and testing, and grading the thickness of elastomeric layer 30, 31.

Various changes, alternatives and modifications will become apparent to those skilled in the art following a reading of the foregoing specification. It is intended that all such changes, alternatives and modifications fall within the appended claims be considered part of the present invention.

I claim:

1. A low-profile, retrofittable, improved-service-life, elastomeric mounting for use in conjunction with a three-piece, railroad-car truck for providing flexibility, truck centering, wheel load equalization, and wheel and axle alignment in curves, said improved elastomeric mounting being mounted between an axle-box or axle-bearing adapter and a side-frame-pedestal jaw of said three-piece, railroad-car truck, comprising:

a) a top-plate means; and b) a bottom-plate means; and c) a shim means spaced intermediate said top-plate means and said bottom-plate means defining a first space between said shim means and said top-plate means and a second space between said shim means and said bottom-plate means; and d) elastomer filling both said first space between said top-plate means and said shim means and said second space between said bottom-plate means and said shim means, thus forming first and second elastomeric layers; and e) said top-plate means including restraining means for restricting lateral movement of said top-plate means relative to said side-frame-pedestal jaw; and f) said bottom-plate means including restraining means for restricting movement of said bottom-plate means relative to said axle-box or axle-bearing adapter; and g) each said elastomeric layer having a shape factor, defined as the ratio of load area of said elastomeric layer to the area in which the elastomer is free to bulge known as the bulge area, greater than 8.0, such that motions resulting from braking and rocking result in shearing motion of each said elastomeric layer and minimize cocking motion in each said elastomeric layer; and h) said elastomeric mount including sprue means which are located on said mounting in an area other than the fore and aft edges of said first and second elastomeric layers:

whereby said improved elastomeric mounting is easily retrofittable onto a three-piece, railroad-car truck.

2. An improved elastomeric mounting in accordance with claim 1 wherein at least one of the group including said top-plate means and said bottom-plate means include restraining means which include at least one depending flange.

3. An improved elastomeric mounting in accordance with claim 2 wherein said bottom-plate means' restraining means includes at least one downwardly depending flange.

4. An improved elastomeric mounting in accordance with claim 2 wherein said top-plate means' restraining means includes at least one upwardly depending flange.

5. An improved elastomeric mounting in accordance with claim 2 wherein said bottom-plate means includes a plurality of generally laterally extending flanges.

6. An improved elastomeric mounting in accordance with claim 2 wherein at least one of said bottom-plate means' and said top-plate means' restraining means further includes at least one pin.

7. An improved elastomeric mounting in accordance with claim 1 wherein at least one of said first and second elastomeric layers includes a center thickness "$t_1$" and an edge thickness "$t_2$" and said center thickness "$t_1$" is less than said edge thickness "$t_2$" in the ratio of "$t_2$"/"$t_1$"=1.05 to 1.30.

8. An improved elastomeric mounting in accordance with claim 1 wherein contour means are added to an edge of at least one of said first and second elastomeric layers.

9. An improved elastomeric mounting in accordance with claim 8 wherein said contour means are selected from the group of contour shapes including substantially circular and substantially elliptical.

10. An improved elastomeric mounting in accordance with claim 1 wherein said top-plate means, said bottom-plate means and said shim means are made of a material which is selected from the group of materials including steel, aluminum, engineered plastic and composites.

11. An improved elastomeric mounting in accordance with claim 10 wherein said elastomeric mounting having a free height of less than 1.25 inch, as such minimizing the increase in ride height of the railroad-car truck needed for railroad-car coupling.

12. An improved elastomeric mounting in accordance with claim 11 wherein the elastomeric layers are bonded to at least one of said top-plate means, bottom-plate means and shim means.

13. An improved elastomeric mounting in accordance with claim 10 wherein, at least a portion of said elastomeric mounting is encapsulated in a material selected from the group including elastomer and adhesive.

14. An improved elastomeric mounting in accordance with claim 13 wherein, the elastomeric layers are bonded to at least one of said top-plate means, bottom-plate means and shim means.

15. An improved elastomeric mounting in accordance with claim 1 wherein at least one of the group containing said top-plate means, said bottom-plate means, and said shim means includes at least one hole therethrough.

16. A low-profile, retrofitting, improved-service-life, elastomeric mounting for use in conjunction with a three-piece, railroad-car truck for providing flexibility, truck centering, wheel load equalization, and wheel and axle alignment in curves, said improved elastomeric mounting being mounted between an axle-box or axle-bearing adapter and a side-frame-pedestal jaw of said three-piece, railroad-car truck, comprising:

a) a top-plate means; and b) a bottom-plate means; and c) a shim means spaced intermediate said top-plate means and said bottom-plate means defining a first space between said shim means and said top-plate means and a second space between said shim means and said bottom-plate means; and d) elastomer filling both said first space between said top-plate means and said shim means and said second space between said bottom-plate means and said shim means, thus forming first and second elastomeric layers; and e) said top-plate means including restraining means for restricting lateral movement of said top-plate means relative to said side-frame-pedestal jaw; and f) said bottom-plate means including restraining means which includes at least one depending flange for restricting movement of said bottom-plate means relative to said axle-box or axle-bearing adapter; and g) each said elastomeric layer having a shape factor, defined as the ratio of load area of said elastomeric layer to the area in which the elastomer is free to bulge known as the bulge area, greater than 8.0, such that motions resulting from braking and rocking result in shearing motion of each said elastomeric layer and minimize cocking motion in each said elastomeric layer; and h) at least one of said first and second elastomeric layers includes a center thickness "$t_1$" and an edge thickness "$t_2$" and said center thickness "$t_1$" is less than said edge thickness "$t_2$" in the ratio of "$t_2$"/"$t_1$"=1.05 to 1.30;

whereby said improved elastomeric mounting is easily retrofittable onto a three-piece, railroad-car truck.

17. An improved elastomeric mounting in accordance with claim 16 wherein the bottom plate means is flat and has at least one laterally extending tab.

18. An improved elastomeric mounting in accordance with claim 16 wherein said contour means are added to an edge of at least one of said first and second elastomeric layers.

19. An improved elastomeric mounting in accordance with claim 16 wherein said top-plate means, said bottom-plate means and said shim means are made of a material which is selected from the group of materials including steel, aluminum, engineered plastic and composites.

20. An improved elastomeric mounting in accordance with claim 16 wherein said improved mounting includes sprue means which are located on said mounting in area other than the fore and aft edges of said first and second elastomeric layers.

21. A low-profile, retrofitting, improved-service-life, elastomeric mounting for use in conjunction with three-piece, railroad-car truck for providing flexibility, truck centering, wheel load equalization, and wheel and axle alignment in curves, said improved elastomeric mounting being mounted between an axle-box or axle-bearing adapter and a side-frame-pedestal jaw of said three-piece, railroad-car truck, comprising:

a) a top-plate means; and b) a bottom-plate means; and c) a shim means spaced intermediate said top-plate means and said bottom-plate means defining a first space between said shim means and said top-plate means and a second space between said shim means and said bottom-plate means; and d) elastomer filling both said first space between said top-plate means and said shim means and said second space between said bottom-plate means and said shim means, thus forming first and second elastomeric layers; and e) said top-plate means including restraining means for restricting lateral movement of said top-plate means relative to said side-frame-pedestal jaw; and f) said bottom-plate means including restraining means which includes at least one depending flange for restricting movement of said bottom-plate means relative to said axle-box or axle-bearing adapter; and g) each said elastomeric layer having a shape factor, defined as the ratio of load area of said elastomeric layer to the area in which the elastomer is free to bulge known as the bulge area, greater than 8.0, such that motions resulting from braking and rocking result in shearing motion of each said elastomeric layer and minimize cocking motion in each said elastomeric layer; and h) said contour means are added to an edge of at least one of said first and second elastomeric layers; and i) said elastomeric mount including sprue means which are located on said mounting in an area other than the fore and aft edges of said first and second elastomeric layers.

whereby said improved elastomeric mounting is easily retrofittable onto a three-piece, railroad-car truck.

22. An improved elastomeric mounting in accordance with claim 21 wherein said top-plate means, said bottom-plate means and said shim means are made of a material which is selected from the group of materials including steel, aluminum, engineered plastic and composites.

23. An improved elastomeric mounting in accordance with claim 21 wherein at least one of said first and second elastomeric layers includes a center thickness "$t_1$" and an edge thickness "$t_2$" and said center thickness "$t_1$" is less than said edge thickness "$t_2$" in the ratio of "$t_2$"/"$t_1$"=1.05 to 1.30.

* * * * *